US009892578B1

(12) United States Patent
Gage et al.

(10) Patent No.: US 9,892,578 B1
(45) Date of Patent: Feb. 13, 2018

(54) GARAGE AUTOMATIC OPEN OR CLOSE LINKED TO VEHICLE GEARSHIFT

(71) Applicant: Toyota Motor Engineering & Manufacturing North America, Inc., Erlanger, KY (US)

(72) Inventors: Sergei I. Gage, Redford, MI (US); Arata Sato, Ann Arbor, MI (US)

(73) Assignee: Toyota Motor Engineering & Manufacturing North America, Inc., Erlanger, KY (US)

( * ) Notice: Subject to any disclaimer, the term of this patent is extended or adjusted under 35 U.S.C. 154(b) by 0 days.

(21) Appl. No.: 15/278,122

(22) Filed: Sep. 28, 2016

(51) Int. Cl.
*G07C 9/00* (2006.01)

(52) U.S. Cl.
CPC ..... *G07C 9/00182* (2013.01); *G07C 2009/00928* (2013.01)

(58) Field of Classification Search
None
See application file for complete search history.

(56) References Cited

U.S. PATENT DOCUMENTS 6,476,732 B1 11/2002 Stephan
6,615,132 B1 9/2003 Nagasaka et al.
6,970,073 B2 11/2005 Drummond et al.
8,095,260 B1 1/2012 Schofield et al.
9,189,952 B2 11/2015 Chutorash et al.
9,264,673 B2 2/2016 Chundrlik et al.
2015/0137941 A1 5/2015 Bauer et al.

*Primary Examiner* — Daniell L Negron
(74) *Attorney, Agent, or Firm* — Dinsmore & Shohl LLP

(57) ABSTRACT

A vehicular garage door operating assembly, a vehicle and a method of opening or closing a garage door. The assembly includes an electronic control unit, a receiver, a garage door remote control, and a gear status indicator. Upon receipt of at least a signal pertaining to a spatial position of the vehicle, a signal pertaining to a positional status of the garage door and a signal indicating that a change in vehicular gear selection, the garage door remote control selectively transmits an instruction signal for automatic opening or closing the garage door without manual intervention by the driver. In this way, when an egress maneuver by the vehicle relative to the garage is being initiated such as by a shift in gears, this is detected along with whether the vehicle is situated within the garage and whether the garage door is closed, the garage door may be automatically moved to an open position to permit egress of the vehicle from the garage. In one exemplary form, the garage door can be made to automatically open when the vehicle is situated within a garage and the vehicular gear selection is changed from PARK to REVERSE once the vehicle has been started.

20 Claims, 4 Drawing Sheets

GARAGE AUTOMATIC OPEN OR CLOSE LINKED TO VEHICLE GEARSHIFT

TECHNICAL FIELD

The present specification relates generally to a vehicular garage door opening and closing assembly, and more particularly to such an opening and closing assembly that operates automatically upon switching gear settings within a vehicle.

BACKGROUND

Garage door opener (GDO) systems typically require that the user of a vehicle physically interact with the GDO through a wireless transmitter or related remote control device for the purpose of signally instructing a motorized linkage to open or close a garage door. For example, in most systems, a user must manually press a button on an in-vehicle transmitter to operate the GDO. The activation range of most such devices is limited to a relatively short range (typically no more than about 100 feet). More recently, such systems have been included as part of an inner (i.e., rear-view) mirror assembly that may use a human-machine interface (HMI) in the form of push buttons, speakers or the like as a way to effect door opening and closing instructions while taking advantage of share components. Even more recently, vehicles have incorporated telematics systems in conjunction with global positioning systems (GPS) or other position determining devices. Such systems can use a driver's cellular telephone as a data carrier in order to ascertain a vehicle's spatial coordinates and travel direction, as well as to achieve additional wireless communication capacity, including connection to the internet to permit remote control of various suitably-connected devices or systems. The GDO is one such system that can be connected via combination of one or more of telematics, GPS and the internet to effect additional functionality.

Nevertheless, to date there has been no attempt to have a vehicular garage door system that is responsive to a change in the gear selector as a way to achieve automated opening and closing operation. Moreover, there has been no attempt to combine gear shift changes with position determining devices to effect fully automated garage door operation that takes into consideration the vehicle's spatial position relative to the door being opened and closed.

SUMMARY

In one embodiment, a vehicular garage door operating assembly is disclosed. The assembly includes an electronic control unit (ECU), a receiver cooperative with the ECU and a GPS or related vehicular position determining system, a garage door remote control cooperative with the ECU, and a gear status indicator cooperative with a vehicular gear selector to provide indicia of a shift in gears to the garage door remote control. A control logic contained in one or both of the garage door remote control and the ECU can obtain an open or closed status of a signally-connected garage door, as well as selectively generate an instruction signal for opening or closing of such a garage door. The assembly is configured such that upon receipt of various signals that meet a predetermined criteria, the garage door remote control transmits the instruction signal for opening or closing the garage door. The received signals include as a first criterion a spatial position signal from the GPS to indicate whether the vehicle is situated within a garage. A second criterion provides an indication of a shift in gears from the gear status indicator, while the third criterion corresponds to a received status indication of whether the garage door is in an open or closed position. If all of the criteria are met, the assembly automatically opens the garage door to permit the vehicle to exit the garage. In an optional form, the spatial position criterion may be used by the control logic in conjunction with the other criteria to determine if an imminent egress maneuver by the vehicle relative to the garage is being made, undertaken or contemplated. In another optional form, the instruction signal can subsequently close the garage door automatically once the vehicle has left the garage.

In another embodiment, a vehicle is disclosed that includes a platform made up of a wheeled chassis, a motive power unit secured to and propulsively cooperative with the platform, a passenger compartment, a guidance apparatus cooperative with the wheeled chassis and a transmission with a gear selector to provide operational control of the vehicle. In addition, the vehicle includes a garage door operating assembly made up of an ECU, a receiver that is cooperative with both the ECU and a vehicular position determining system, a garage door remote control and a gear status indicator cooperative with the gear selector. The assembly is configured such that upon receipt and control logic-based processing of various signals, the garage door remote control selectively transmits the instruction signal for opening a closed, signally-connected garage door. As with the previous embodiment, the signals make up decision criteria for the control logic that is coupled to or otherwise cooperative with the ECU or related microcontroller, and include a spatial position signal from the vehicular position determining system. Another of the received signals is indicative of a shift in gears; this signal is provided by the gear status indicator that provides indicia of which of the P-R-N-D-L modes chosen by the driver through the gear selector. The received signal corresponding to the garage door status indication provides information about whether the garage door is in an open or closed position. These signals are conveyed to the ECU through the receiver, while the control logic contained within one or both of the garage door remote control and the ECU is structured to selectively generate an instruction signal for opening the garage door based on the information provided by these signals. Because data associated with the spatial position can provide proximity information as well as travel direction information (the latter including whether the vehicle is getting closer to or farther from the signally-connected garage), such data may optionally be useful to indicate that an egress maneuver by the vehicle relative to the garage is being made, contemplated or undertaken. In another optional form, the instruction signal can subsequently close the garage door automatically once the vehicle has left the garage.

In yet another embodiment, a method of automatically operating a garage door from a vehicle is disclosed. The method includes detecting various signals that—once suitably processed by the control logic contained within the control logic that is embodied within a garage door operating assembly—make up the criteria used to determine if automated opening or closing of the garage door is to be provided. The signals that make up the criteria are sensed from various sources. A first of the sources is a vehicular position determining system, where the signal corresponds to a spatial position of the vehicle relative to a garage to which the garage door is movably secured. A second of the sources is a gear status indicator that provides indicia of which gear or related transmission setting is engaged, while a third of the sources is a status indication of whether the garage door is open or closed. The method further includes using a control logic associated with an ECU to process, the first, second and third signals to determine if all of the criteria associated with the signals to open the garage door are met, and then using a garage door remote control that is coupled to the ECU to send an instruction signal to a garage door opener for the opening the garage door only if all of the criteria are met. The criteria includes having the first signal indicate that the vehicle is situated within the garage, while the second signal includes an indication that the garage door is closed and the third signal includes an indication that a shift in gears has taken place. It will be understood that additional criteria may also apply, such as having the vehicle be in an operational status, such as having its motive power unit turned on such that that an egress maneuver by the vehicle relative to the garage is imminent, having all of the passenger doors be closed, or the like.

These and additional features provided by the embodiments described herein will be more fully understood in view of the following detailed description, in conjunction with the drawings.

BRIEF DESCRIPTION OF THE DRAWINGS

The embodiments set forth in the drawings are illustrative and exemplary in nature and not intended to limit the subject matter defined by the claims. The following detailed description of the illustrative embodiments can be understood when read in conjunction with the following drawings, where like structure is indicated with like reference numerals and in which:

DETAILED DESCRIPTION

Figure 1:
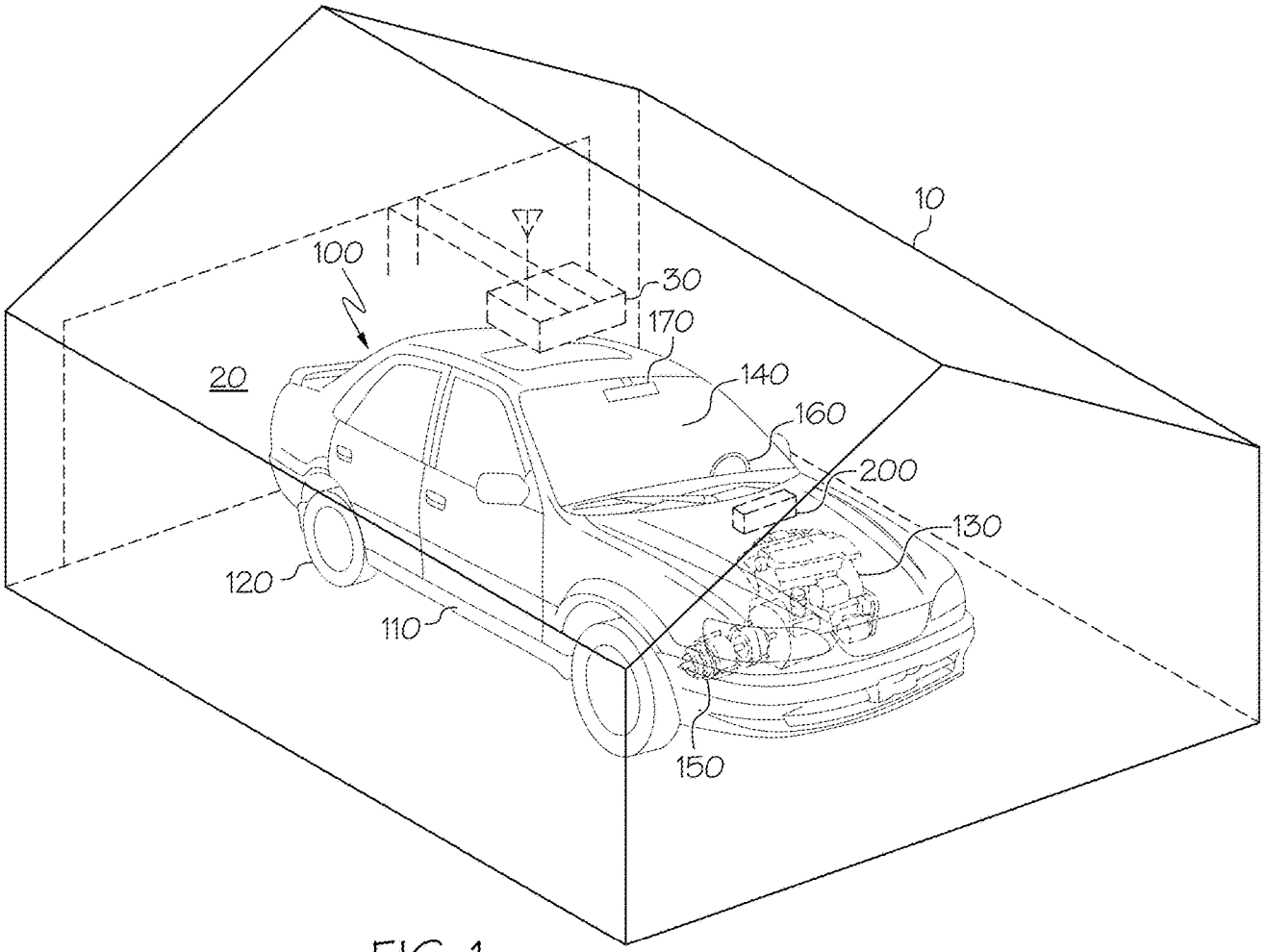
FIG. 1 depicts a vehicle parked within a garage with an automated garage door opening and closing system in accordance with one or more embodiments shown or described herein.

Embodiments disclosed herein include an assembly that can be used in conjunction with a vehicle and a vehicular position determining system so that movement of the vehicle associated with changing its gear setting can be used to automatically open or close a garage door that is signally coupled to the assembly. As will be discussed in more detail herein, FIG. 2 generally depicts one embodiment of such an assembly 1 that is made up of an ECU 200, one or more receivers 300, a garage door remote control 400 and a gear selector 500 with a status indicator 520. Information obtained that relates a spatial position of the vehicle 100 to a suitably-equipped garage door 20 is used in conjunction with changes in the vehicle 100 gear selector 500 settings and a present open or closed status of the garage door 20 in order to be used as criteria to determine if the assembly 1 should automatically change the position of the garage door 20 from open to closed or vice versa.

Referring first to FIG. 1, a garage 10 and door 20 are used to store vehicle 100 during periods where the vehicle 100 is not operational. Within the present context, although vehicle 100 is presently depicted as a car in general, and a sedan in particular, it will be appreciated that the term "vehicle" may apply to car, truck, van, sport utility vehicle (SUV) or related architecture, so long as such architecture is capable of fitting into a comparably-configured garage 10. GDO 30 is connected to both the garage 10 and the door 20 such that upon a signal-based instruction from a wireless garage door remote control that is discussed in more detail below, the GDO 30 can selectively raise or lower the garage door 20.

Vehicle 100 includes a chassis 110 with a plurality of wheels 120. Chassis 110 may either be of body-on-frame or unibody construction, and both configurations are deemed to be within the scope of the present disclosure. A motive power unit 130 such as a conventional internal combustion engine (ICE), battery pack, fuel cell stack or a hybrid combination of one or more of the above may be situated in or on the chassis 110 to provide propulsive power to the vehicle 100. As shown, the motive power unit 130 is situated underneath a hood that is placed at the fore end of vehicle 100. A passenger compartment 140 is formed inside the chassis 110 and serves not only as a place to transport passengers and cargo, but also as a place from which a driver may operate vehicle 100. A transmission 150 is coupled to the motive power unit 130 such that together they form a drivetrain through which a torque may be applied to some or all of the wheels 120. In a preferred configuration, the transmission 150 is an automatic transmission; however, it will be appreciated that the assembly 1 of the present disclosure may be used in conjunction with manual transmissions as well. A guidance apparatus (which may include, among other things, steering wheel, accelerator, brakes or the like) 160 is used in cooperation with the wheels 120, motive power unit 130, transmission 150 and other systems to control movement of the vehicle 100. Within the passenger compartment 140, an inner mirror 170 (also referred to as a rearview mirror) is mounted to provide a driver with a view of what is behind vehicle 100. As will be described in more detail below, such mirror 170 may include some or all of the assembly 1 features discussed herein in order to increase its functionality.

Figure 2:
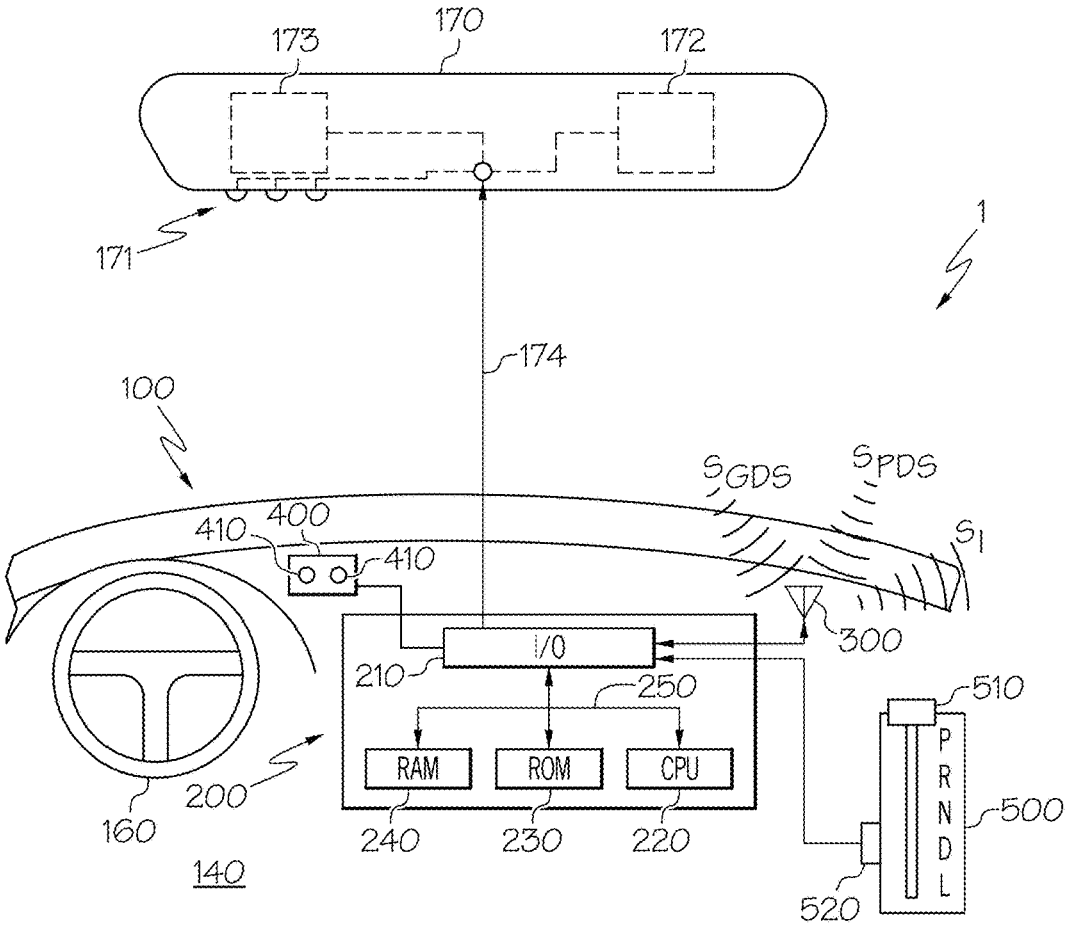
FIG. 2 depicts an internal passenger compartment view of the vehicle of FIG. 1 showing the cooperation of an electronic control unit, signal transmitter and receiver, garage door remote control and an inner mirror according to one or more embodiments shown or described herein.

Referring next to FIG. 2, the driver's portion of a vehicle passenger compartment 140 is shown. In particular, a steering wheel 160 forms part of the guidance apparatus that is used to control driving speed and direction. In addition, a gear selector 500 (also referred to as a gear shifter or the like) is typically mounted on a center console (not shown) that separates the driver from the other front-seat passenger. In configurations where vehicle 100 is outfitted with an automatic transmission 150 that has a conventional gearing system that includes a park, reverse, neutral and a plurality of forward gears, the gear selector 500 is comparably arranged in the P-R-N-D-L format, where changing gears between these settings may be effected through movement of a gear shift lever 510. To instruct the transmission 150 to engage one of the corresponding PARK, REVERSE, NEUTRAL or DRIVE operational modes or positions. A gear status indicator 520 (which may be in the form of a sensor) is used to send a signal to the ECU 200 to provide an indication of the presently-selected gear. Although not shown, the transmission 150 may be configured to not respond to changes entered via gear selector 500 until the assembly 1 determines that the motive power unit 130 is in the ON position, where such information may be correlated with the main ignition switch position or the like. The use of the gear status indicator 520 coupled with the garage door remote control 400 is beneficial in that it allows the assembly 1 to achieve automated operation of opening or closing the garage door 20 every time the vehicle 100 goes through a change of gears when the vehicle is inside or close to the garage 20.

Within the present context, the terms "gear shift change", shift in gears", shift in transmission gears", "shift in a transmission setting" and their variants are all meant to cover situations where a driver of vehicle 100 has engaged the gear selector 500 to effect a change in the forward, backward or parking mode of operation of vehicle 100. As such, the vehicle 100 is deemed to go through such a change in gears only when the gear selector 500 has moved from one operational setting to another such that the transmission 150 recognizes or responds to the request made through the selector 500. By way of non-limiting examples, if the gear shift lever 510 of gear selector 500 is moved from PARK to REVERSE, from PARK to DRIVE, from REVERSE to DRIVE or DRIVE to REVERSE, the operational setting of the gear selector 500 (and derivatively, the transmission 150) is deemed to be suitably changed. Contrarily, a mere upshifting or downshifting that accompanies the normal progression within an automatic transmission as vehicle 100 speeds up or slows down is not deemed to constitute such a gear change as defined herein.

Although shown schematically as being within the passenger compartment 140, it will be appreciated that the ECU 200 is situated in any suitable location within vehicle 100 where access to wiring, harnesses or busses is readily available. In addition, it will be appreciated that ECU 200 may be one of many such control units within the vehicle 100, depending on the desired degree of integration or autonomy among such control units. ECU 200 is provided with one or more input/output (I/O) 210, microprocessor (CPU) 220, read-only memory (ROM) 230, random-access memory (RAM) 240, which are respectively connected by a bus to provide connectivity for a logic circuit 250 for the receipt of signal-based data, as well as the sending of commands or related instructions. Various algorithms and related control logic may be stored in the ROM 230 or RAM 240 in manners known to those skilled in the art. Thus, in one form, CPU 220 can be made to operate on the opening/closing (i.e., control) logic for garage door 20 such that individually and together the various components making up ECU 200 define the logic circuit 250 needed to provide the automated opening and closing control of the garage door 20 as discussed herein. The control logic may be embodied in an algorithm or related program code that can be manipulated or otherwise operated on by CPU 220 and then conveyed via I/O ports 210 to one or both of the receiver 300 and garage door remote control 400 the latter of which occurs when operating as an antenna as discussed below. In one form of I/O 210, signals from the interior rearview mirror 170, the garage door remote control 400, the receiver 300 and gear selector 500 are exchanged with ECU 200. Other such signals, such as an ignition signal (not shown) that indicates whether or not the engine or related motive power unit 130 is operational may also be signally provided to ECU 200 for suitable processing by the control logic.

Within the passenger compartment 140, the interior rearview mirror 170 may be configured as an assembly to include additional functionality. In one form, the mirror 170 may include electrochromic features such that it may act as a variable display; such features may include a display of compass settings 172, auto-dimming or related variations in reflectance (not shown), a message/warning indicator 173 (such as for engine warnings, door openings or other vehicular systems), backing camera (not shown) such as those associated with a reversing maneuver or other video display. Mirror 170 may have forward-and rearward-facing photocells or related sensors to measure ambient light conditions for use in such mirror-dimming, as well as for headlamp control or the like. Buttons 171 may be mounted on the mirror 170 as a form of HMI; other forms (not shown) may also be included into the housing of mirror 170, such as a microphone/speaker, display-based touch screen or the like. Likewise, control signals sent from or received by the mirror 170 may be routed through a circuit 174, which may be in the form of a wired or wireless connection between the mirror 170 and the ECU 200.

As with ECU 200, the garage door remote control 400 is notionally shown as being situated within the passenger compartment 140. It will likewise be appreciated that the garage door remote control 400 may be placed in any suitable location within vehicle 100 where simplified driver access to its one or more buttons 410 is desired. In one form, the garage door remote control 400 is a portable, battery-powered stand-alone device, while in another it can be linked through the mirror 170 so that HMI controls such as buttons 171 may act as a surrogate for buttons 410. As part of a control logic that defines the opening and closing instruction signals $S_I$ that are transmitted to the GDO 30, the garage door remote control 400 preferably provides wireless control or instruction signals $S_I$ to the GDO 30. In one form, the garage door remote control 400 is configured to operate in a radio frequency range of between 300-400 MHz with encoded hopping or rolling code technology for added operational security. Signal ranges $S_R$ (such as that shown in conjunction with FIG. 3) for the garage door remote control 400 are between about 25 feet and 100 feet, although longer ranges associated with higher-power transmitters and more sensitive versions of receiver 300 are deemed to be within the scope of the present disclosure. Garage door remote control 400 can be made to transmit either a radio wave or an infrared signal with corresponding signal ranges $S_R$ know to those skilled in the art. For example, the garage door remote control 400 may be made to operate through a telematics unit (not shown) in vehicle 100 that is signally coupled to a mobile telephone (such as a smartphone or the like) so that a wireless cellular communication network—either with or without an internet connection—may be used with GDO 30 over any range where cellular continuity between them is available.

Although the microcontroller and related circuitry that makes up ECU 200 is shown in FIGS. 1 and 2 as being a stand-alone component, it will be appreciated that it may also have numerous parts in common with other devices, such as the garage door remote control 400 or the mirror 170, among others. In such case, it may be that in variants of the disclosed assembly, one or more of the essential ECU 200 features may be formed as part of such garage door remote control 400 or mirror 170. It is equally likely that the garage door remote control 400 may be formed as part of the ECU 200, and that all such variants are deemed to be within the scope of the present disclosure. It is likewise contemplated within the present disclosure that various transmitters, receivers (such as antenna 300 shown in FIGS. 1 and 2, along with associated circuitry) and other wireless communication equipment that are used to establish signal communication between vehicle 100 and other remote devices (such as GDO 30 or GPS 800) may be formed as part of—or independently from—any or all of the mirror 170, ECU 200 or garage door remote control 400, and that all such variants are deemed to be within the scope of the present disclosure. Thus, by way of example, it will be appreciated that in one form, the garage door remote control 400 may have its own autonomous antenna with which to achieve wireless communication with GDO 30, while in another it can use common equipment with the other components (such as the ECU 200 and the receiver 300 so that input and output can go directly through such other components. In this way, redundancy of components may be avoided.

Within the present context, it will be appreciated that the antenna depicted for each of GDO 30 and receiver 300 may be used to not only receive wireless signal, but as a transmitter of signals as well in such situations where such two-way communication is required. Likewise, although the term "receiver" is used, it will be appreciated that in situations where two-way communication is required, the receiver (such as receiver 300) may be configured as a transceiver in order to effect such two-way communication, and that both variants are deemed to be within the scope of the present disclosure.

Figure 3:
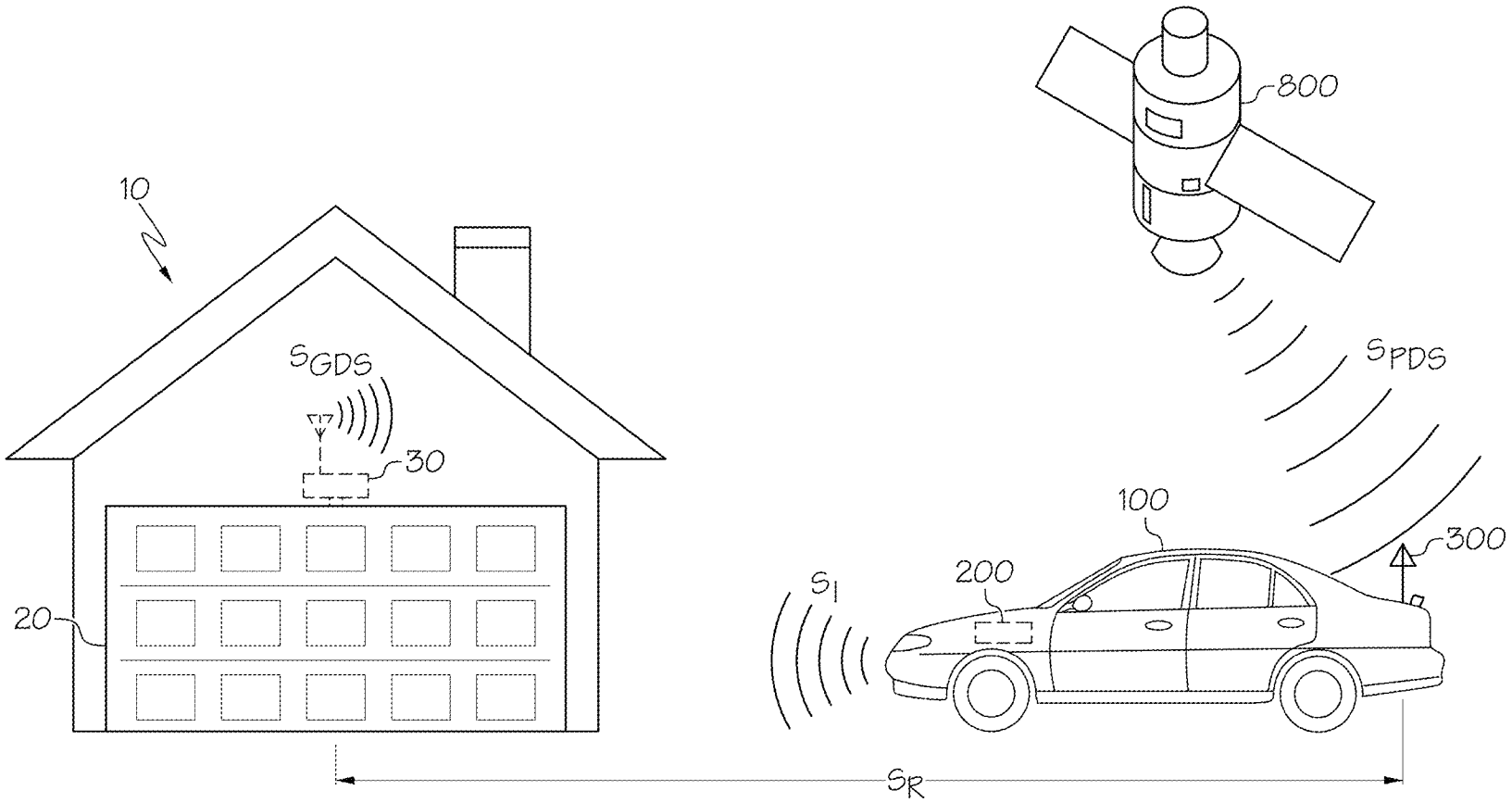
FIG. 3 depicts the signal communication between the vehicle and the garage of FIGS. 1 and 2 when the vehicle is outside, and further where a global positioning system (GPS) can be used to provide vehicular spatial position and travel direction information according to one or more embodiments shown or described herein.

Referring next to FIG. 3, the cooperation of the vehicle 100 and the vehicular position determining system 800 is shown, where the vehicular position determining system 800 is notionally depicted as a GPS system. As is understood by those skilled in the art, the vehicular position determining system 800 can provide through triangulation and associated means the ability to provide navigational information, including accurately pinpointing a spatial position of the vehicle 100 (particularly as it relates to whether vehicle 100 is situated within a signally-connected garage 10), as well as provide a direction of travel of the vehicle 100. In the present context, the travel direction corresponds to the direction or orientation that the front end of vehicle 100 is pointed in when associated with normal (i.e. forward) movement, as well as the direction or orientation that the rear end of vehicle 100 is pointed in when associated with reverse vehicular movement. A GPS receiver (which in one form may be integrated into ECU 200, a telematics system or other device suitably equipped with an antenna or related receiver, such as receiver 300) receives position determining signals $S_{PDS}$ from various space-based GPS satellites (only one of which is shown), and calculates a position of the vehicle 100 against known maps in order to place the vehicle 100 within a unique spatial position. Within the present context, such spatial position takes on special significance when it is generally within a signal range $S_R$ of the GDO 30 that corresponds to the garage door remote control 400 and more particularly when such signal range $S_R$ is within garage 10 that houses the GDO 30, as in either case it satisfies the criterion that a garage door status signal $S_{GDS}$ being sent by GDO 30 can reach vehicle 100. Variations in the spatial position such as that associated with an egress of the vehicle 100 from the garage 10 may also be provided by other non-GPS means, such as by a vehicle speed or wheel sensor that measures wheel movement. In another form, an inertial navigation sensor (INS) that may employ gyroscopic sensors to detect angular changes in vehicular movement to provide updates to the spatial position; such updates are especially prevalent in situations where the vehicle 100 has not traversed a significant distance, such as when it is in the garage 10 or on a driveway or road that is contiguous with the garage 10 and within visual range or signal range $S_R$ of the GDO 30.

Within the present context, an egress maneuver that is optionally associated with one or more of the three vehicle 100 criteria is considered to be made, undertaken, contemplated, initiated or imminent when it takes place from either within or outside but adjacent (such as on a contiguous driveway) the signally-connected garage 10 that is within the signal range $S_R$ of the garage door remote control 400, and further where a change in the gear selector 500 setting takes place to indicate that the driver intends to move the vehicle 100 away from the garage 10 and its door 20. Furthermore within the present context, an egress maneuver is deemed to be taking place or contemplated only when the vehicle 100 is in an operational (i.e., "on") state. Thus, when the ignition is turned on such that the motive power unit 130 (whether ICE, fuel cell stack, battery pack of a hybrid combination of any of the three) is operational to provide propulsive power to vehicle 100, such egress is possible, while in situations where the ignition is turned off, no such egress is possible until such time as the ignition has been engaged Likewise, a change of gears through the gear selector 500 is deemed to have relevance to the present disclosure only when the ignition has been turned to the "on" or "start" position.

Such egress maneuver has particular relevance in two situations. First, when vehicle 100 is in the garage 10 and the driver wants to move the vehicle 100 out, the receipt by the ECU 200 of a signal from the gear selector 500 to shift the transmission 150 into REVERSE (in situations where the rear of vehicle 100 is adjacent the closed garage door 20) or into DRIVE (in situations where the front of vehicle 100 is adjacent the closed garage door 20) in order to effect corresponding movement of vehicle 100.

Second, once the vehicle 100 has been moved out of the garage 10, there may be circumstances where it is desirable to have the garage door 20 close automatically, such as once the vehicle 100 making the egress has traversed a certain predetermined distance from the garage 10 (such as leaving an associated driveway or travelling down an adjacent street). Because the assembly 1 remains in communication with GPS 800 or other vehicle spatial position determining system (assuming no visual range obstruction such as a tunnel or the like), the received first signal may also be used by the control logic that is contained within any or all of the ECU 200, garage door remote control 400 and mirror 170. This signal in turn may be used to alert the assembly 1 that the vehicle is moving away from the garage door that just opened, and that it is now necessary to perform an opposite automatic closing operation. It will be appreciated that the use of such a signal to perform an optional closing of the garages door 20 once the vehicle 100 has traversed such a distance away from the garage preferably needs to be coordinated with the operation of the garage door remote control 400 to ensure that the vehicle 100 is within the signal range $S_R$. As mentioned above, in situations where the signal ranges $S_R$ for the garage door remote control 400 are between about 25 feet and 100 feet, it would be necessary to have such predetermined distance be less than that so that a door closure instruction signal can be sent prior to vehicular attainment of a distance farther away. In addition, the predetermined distance that triggers the garage door 20 closure signal may be made to have a manual override for those circumstances where it is desired to leave the garaged door 20 remain open even as the vehicle 100 moves away from the garage 10. Of course, in situations where a telematics system or related cellular or internet-based wireless communication can be provided between the vehicle 100 and the GDO 30, the signal range $S_R$ may no longer be a limiting factor in how long such a predetermined egress distance is in order to effect door 20 closure. Instead of using the GPS 800 to determine the spatial position of vehicle 100 (including its position relative to garage 10), in another embodiment, autonomous ascertainment of such a predetermined distance may be made through an INS, odometer or a signal-generating device (such as a radar-or infrared-based sensor) in order to trigger the automatic closing of the garage door 20 once the vehicle has left the garage 10 and made an additional egress maneuver. All such ways to acquire the predetermined distance are deemed to be within the scope of the present disclosure.

Further within the present context, all three criteria associated with signals received by and processed within the ECU 200 or related logic-based microcontroller act as a necessary precursor for the automated garage door opening or closing disclosed herein. This includes not just the signal corresponding to vehicle 100 egress maneuvers, but also the signal corresponding to the status indication of the garage door 20 and the signal corresponding to a shift in gears from the gear status indicator.

Figure 4:
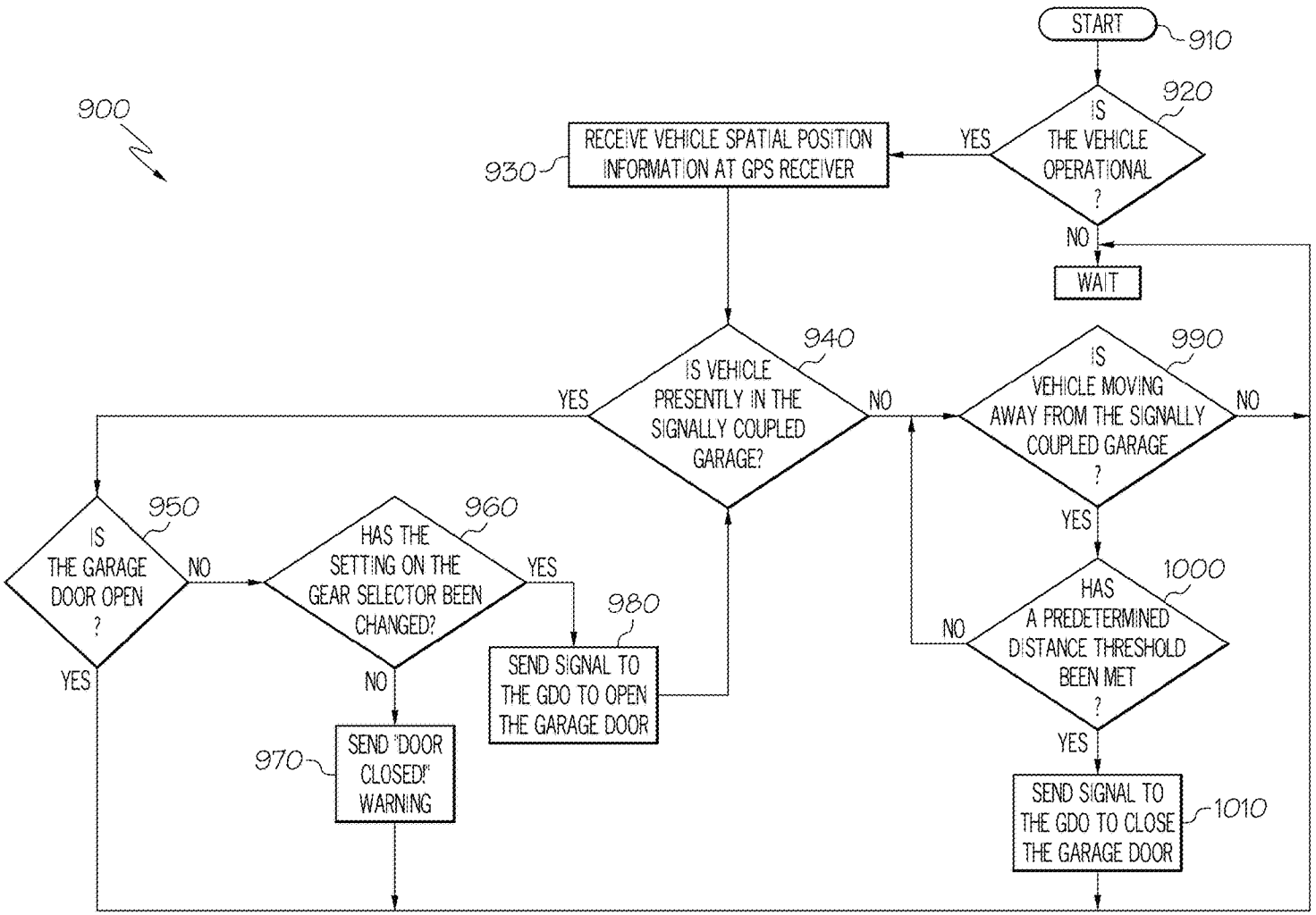
FIG. 4 depicts a flowchart illustrating the selective movement of the garage door according to one or more embodiments shown or described herein.

Referring next to FIG. 4 in conjunction with FIG. 2, a flowchart depicting the algorithmic procession of some of the portions of the control logic 900 that is loaded, embedded or otherwise signally cooperative with the logic circuit 250 is shown. In the present context, it will be appreciated that the control logic may be voluminous, including potentially thousands of lines of code, including numerous routines and subroutines that can be stored in ROM 230 or RAM 240 accessed by and acted upon by the ECU 200 in general and the CPU 220 in particular. Nevertheless, the discussion below focuses on only those portions of such control logic as being the ones most relevant to the operation of assembly 1, the remaining portions being understood by those skilled in the control unit art.

Starting with step 910, a determination is made at step 920 to ascertain whether vehicle 100 is operational, such as by having its motive power unit 130 running or having its ignition in either the ON or ACCESSORY position. In situations where the vehicle 100 is not operational, the control logic 900 goes into a WAIT status until such time as the vehicle 100 does become operational. At step 930, signals are received (such as from GPS 800) through receiver 300 to provide spatial position of vehicle 100 in a manner well-known in the GPS art. Such signal-based acquisition of the spatial position of vehicle 100 corresponds to the first signal being conveyed to the ECU 200. This provides indicia of where vehicle 100 is presently such that if it is within a signally coupled garage 10 as indicated at step 940, then a determination may be made at step 950 to see if the garage door 20 is open or not. This determination corresponds to the second signal being conveyed to the ECU 200 and that is used to provide a status indication of the garage door 20. Within the present context, a signally coupled garage is one that has a GDO 30 that is operatively paired to the garage door remote control 400 through a unique coding arrangement (such as through matched identification with suitable rolling codes or related security features) so that through normal operation of the garage door remote control 400, the GDO 30 responds by opening or closing the garage door 20 as needed. In a preferred form, the security-based features of the signally coupled relationship between the garage door remote control 400 and the GDO 30 prevent unauthorized opening or closing of the garage door 20 by others. In situations where the garage door 20 is determined to already be open, the control logic 900 returns to the WAIT status until a subsequent event occurs. Contrarily, in situations where the garage door 20 is determined to be closed, the control logic 900 proceeds to step 960 in order to determine if a shift in gear selection through gear selector 500 (such as through movement of the gear shift lever 510 from PARK to REVERSE or from PARK to DRIVE as discussed above) has occurred. If so, which corresponds to the third signal being conveyed to the ECU 200, then all three signal criteria are met such that at step 980 an instruction signal is sent by the ECU 200 to the GDO 30 to instruct it to have its power source, motorized drive unit, transceiver and linkage operate to open the garage door 20. Significantly, it is preferable to have an alarm or related warning as shown in step 970 be deployed in situations where the vehicle 100 is deemed to be both operational and within an enclosed garage 10, at least in vehicle 100 configurations where the motive power unit 130 is an ICE, as otherwise, an undesirable level of carbon monoxide may start to form. Although not shown, such a warning or alarm may be accompanied with one or both of a vehicular ignition shutoff function and an automated garage door 20 opening function the latter of which would be based on the door opening function of step 980. Regardless of whether the inquiry from step 940 is or is not satisfied, the control logic 900 proceeds to step 990 to ascertain whether the vehicle 100 is moving away from the garage 10. If so, then at step 1000 an inquiry is placed as to whether a threshold minimum distance between the vehicle 100 and the GDO 30 has been attained to provide indicia of the driver's desire to move away from the garage 10. If, so, the control logic 900 can instruct the GDO 30 to automatically close the garage door 20 at step 1010. Control logic 900 may also be built into the garage door remote control 400 so that in situations where the garage door 20 may already be closed (for example, in circumstances where the vehicle 100 was parked outside of the garage 10 prior to being started), no such signal such as that of step 1010 need be sent. Likewise, if the garage door remote control 400 does not include such logic, then an additional inquiry similar to that of step 950 may be included interstitially between steps 990 and 1000 in order to moot steps 1000 and 1010; either variant is deemed to be within the scope of the present disclosure. As indicated above, the steps 990 through 1010 associated with closing an open garage door 20 once vehicle 100 has made an egress maneuver from garage 20 and is continuing to move away from garage 10, are optional, and as such may not in certain circumstances be needed as part of the control logic 900.

Importantly, in situations where vehicle 100 is being pulled into garage 10 where door 20 is open, an interlock system may be included to prevent an automatic garage door closure until such time as the motive power unit 130 has been turned off. Thus by way of example, leaving the garage door 20 open during the time where the vehicle 100 is pulled into the garage 10 and switched into PARK mode will prevent an inadvertent buildup of carbon monoxide within the space defined by the garage 10. This distinguishes those situations where the egress maneuver by vehicle 100 has merely ceased temporarily, such as by application of the brakes with enough force to overcome the fluid coupling between the motive power unit 130 and the transmission 150 through a torque converter (not shown). It will be appreciated that such an interlock may only be necessary in situations where the architecture for the motive power source 130 is based on an ICE, as fuel cell stack or battery pack configurations do not emit an appreciable amount of carbon monoxide.

It is noted that the terms "substantially" and "about" may be utilized herein to represent the inherent degree of uncertainty that may be attributed to any quantitative comparison, value, measurement, or other representation. These terms are also utilized herein to represent the degree by which a quantitative representation may vary from a stated reference without resulting in a change in the basic function of the subject matter at issue.

While particular embodiments have been illustrated and described herein, it should be understood that various other changes and modifications may be made without departing from the spirit and scope of the claimed subject matter. Moreover, although various aspects of the claimed subject matter have been described herein, such aspects need not be utilized in combination. It is therefore intended that the appended claims cover all such changes and modifications that are within the scope of the claimed subject matter.

What is claimed is:

1. A vehicular garage door operating assembly comprising:

an electronic control unit;

a receiver cooperative with the electronic control unit and a vehicular position determining system such that a first signal corresponding to a spatial position of a vehicle incorporating the assembly is conveyed to the electronic control unit through the receiver;

a garage door remote control cooperative with the electronic control unit such that a control logic contained within at least one of the garage door remote control and the electronic control unit is configured to obtain a second signal corresponding to a status indication of a signally-connected garage door and selectively generate an instruction signal for opening or closing of such a garage door; and a gear status indicator cooperative with a vehicular gear selector to provide a third signal corresponding to a shift in gears to the garage door remote control, wherein the assembly is configured such that upon receipt of the first, second and third signals and subsequent processing by the control logic, the garage door remote control selectively transmits the instruction signal for opening or closing such a garage door.

2. The assembly of claim 1, wherein the instruction signal comprises an instruction to open such a garage door when (a) the first signal indicates that the spatial position of such a vehicle is within such a garage, (b) the second signal indicates that such a garage door is closed and (c) the third signal indicates that a shift in gears has taken place.

3. The assembly of claim 2, wherein the instruction to open is only sent when the third signal indicates that the shift in gears corresponds to a shift into a REVERSE position.

4. The assembly of claim 2, further comprising wherein the instruction signal additionally comprises an instruction to close such a garage door once (a) such a vehicle is outside of such a garage, (b) the movement direction of such a vehicle is away from such open garage door and (c) such a vehicle has moved a predetermined distance from such a garage.

5. The assembly of claim 1, wherein the garage door remote control is formed as part of an inner mirror that is situated within such a vehicle.

6. The assembly of claim 1, wherein the electronic control unit comprises a part of the garage door remote control.

7. The assembly of claim 1, wherein the garage door remote control comprises a part of the electronic control unit.

8. The assembly of claim 7, wherein the electronic control unit comprises a part of an inner mirror that is situated within such a vehicle.

9. The assembly of claim 1, further comprising a garage door opener comprising a power source, motorized drive unit, transceiver and linkage such that upon receipt by the transceiver of the instruction signal, the garage door opener operates the linkage to open or close such a garage door that is coupled thereto.

10. A vehicle comprising:

a platform comprising a wheeled chassis, a motive power unit secured to the platform and propulsively cooperative therewith, a passenger compartment, a guidance apparatus cooperative with the wheeled chassis and a transmission with a gear selector to provide operational control thereof; and a garage door operating assembly comprising:

an electronic control unit;

a receiver cooperative with the electronic control unit and a vehicular position determining system such that a first signal corresponding to a spatial position of the vehicle is conveyed to the electronic control unit through the receiver;

a garage door remote control cooperative with the electronic control unit such that a control logic contained within at least one of the garage door remote control and the electronic control unit is configured to obtain a second signal corresponding to a status indication of a signally-connected garage door; and a gear status indicator cooperative with the vehicular gear selector to provide a third signal corresponding to a shift in gears to the garage door remote control, wherein the assembly is configured such that upon receipt of the first, second and third signals and subsequent processing by the control logic, the garage door remote control selectively transmits the instruction signal for opening such a garage door.

11. The vehicle of claim 10, wherein the garage door remote control is formed as part of an inner mirror that is situated within the vehicle.

12. The vehicle of claim 11, wherein the electronic control unit comprises a part of the garage door remote control.

13. The vehicle of claim 10, wherein the electronic control unit is formed as part of an inner mirror that is situated within the vehicle.

14. The vehicle of claim 13, wherein the garage door remote control comprises a part of the electronic control unit.

15. The vehicle of claim 10, wherein the instruction signal comprises an instruction to open such a garage door when (a) the first signal indicates that the spatial position of such a vehicle is within such a garage, (b) the second signal indicates that such a garage door is closed and (c) the third signal indicates that a shift in gears has taken place.

16. A method of automatically operating a garage door from a vehicle, the method comprising:

detecting, through a vehicular wireless receiver, a first signal corresponding to a spatial position of the vehicle relative to a garage to which the garage door is movably secured, the signal emanating from a vehicular position determining system;

detecting, with the garage door remote control, a second signal corresponding to a status indication of whether the garage door is open or closed;

detecting, with a vehicular gear status indicator, a third signal corresponding to whether a shift in a transmission setting of the vehicle has been performed;

processing, through a vehicular electronic control unit that includes a control logic, the first, second and third signals to determine if all criteria associated with such signals to open the garage door are met, the criteria comprising (a) having the first signal indicate that the spatial position of the vehicle is within such a garage, (b) having the second signal indicate that the garage door is closed and (c) having the third signal indicate that a shift in gears has taken place; and using a garage door remote control that is coupled to the electronic control unit to send an instruction signal to a garage door opener for the opening the garage door once all the criteria are met.

17. The method of claim 16, wherein the instruction signal comprises an instruction to open the garage door when (a) the first signal indicates that the spatial position of the vehicle is within the garage, (b) the second signal indicates that the garage door is closed and (c) the third signal indicates that a shift in gears has taken place.

18. The method of claim 17, further comprising wherein the instruction signal additionally comprises an instruction to close the garage door once (a) the vehicle is outside the garage, (b) the movement direction of the vehicle is away from the open garage door and (c) the vehicle has moved a predetermined distance from the garage.

19. The method of claim 16, wherein the detecting of a first signal comprises signally connecting a GPS receiver on the vehicle to a GPS system.

20. The method of claim 16, wherein the third corresponds to a shift of a gear selector within the vehicle from a PARK position into a REVERSE position.

* * * * *